US006011245A

United States Patent [19]

Bell

[11] Patent Number: 6,011,245

[45] Date of Patent: Jan. 4, 2000

[54] PERMANENT MAGNET EDDY CURRENT HEAT GENERATOR

[76] Inventor: James H. Bell, P.O. Box 181, Angleton, Tex. 77516

[21] Appl. No.: 09/273,045

[22] Filed: Mar. 19, 1999

[51] Int. Cl.[7] ..... H05B 6/10

[52] U.S. Cl. ..... 219/631; 219/629

[58] Field of Search ..... 219/631, 628, 219/629, 630, 672

[56] References Cited

U.S. PATENT DOCUMENTS

| | | | |
|---|---|---|---|
| 4,217,475 | 8/1980 | Hagerty | 219/631 |
| 4,486,638 | 12/1984 | Bennetot | 219/631 |
| 4,511,777 | 4/1985 | Gerard | 219/631 |
| 4,600,821 | 7/1986 | Fichtner et al. | 219/631 |
| 4,614,853 | 9/1986 | Gerard et al. | 219/631 |
| 5,012,060 | 4/1991 | Gerard et al. | 219/631 |
| 5,773,798 | 6/1998 | Fukumura | 219/631 |

*Primary Examiner*—Philip H. Leung
*Attorney, Agent, or Firm*—Kenneth A. Roddy

[57] ABSTRACT

A permanent magnet eddy current heat generator apparatus has a thermally insulated working fluid reservoir containing a working fluid and an enlongate stationary ferrous metal tube disposed in the reservoir with an elongate permanent magnet rotatably mounted inside the tube that, upon rotation, causes the tube to become heated due to the eddy current generated in the tube side wall and the heat from the tube side wall is transferred to the working fluid in the reservoir. An elongate working fluid heat pipe has a first end connected with a working fluid reservoir outlet and a second end connected with a reservoir inlet. The elongate permanent magnet is rotated by the shaft of a motor electrically and magnetically insulated from the working fluid and elongate permanent magnet. A pump, also driven by the motor shaft, is connected in fluid communication between the working fluid reservoir outlet and the heat pipe to conduct working fluid in a closed loop from the reservoir, through the heat pipe, back into the reservoir, and around the exterior of the ferrous metal tube. The heat pipe is placed in heat exchange relation in a second fluid (liquid, air or gas to be heated, such as in a hot water tank, and the heat of the working fluid conducted through the heat pipe is transferred through the heat pipe side wall to heat the second fluid.

17 Claims, 4 Drawing Sheets

PERMANENT MAGNET EDDY CURRENT HEAT GENERATOR

BACKGROUND OF THE INVENTION

1. Field of the Invention

This invention relates generally to heat exchanger and water heater apparatus, and more particularly to an eddy current heat generator utilizing a permanent magnet rotatably mounted in a fixed ferrous metal pipe inside a working fluid reservoir with the working fluid being conducted through a heat pipe to heat a second fluid (liquid, air or gas).

2. Brief Description of the Prior Art

Conventional domestic water heaters utilize gas burners or electric resistance heating elements to heat the water in the tank of the water heater. A substantial part of the heat that is generated is wasted, and this waste of energy has become increasingly undesirable due to the increasing costs of gas and electricity.

Electric water heaters that utilize electric resistive heater strips or heating elements are highly inefficient, and costly to operate in the long run. Gas water heaters are also inefficient since a significant portion of the heat escapes through the flue.

The use of electromagnetic induction heating of a liquid, and the use of permanent magnets or electromagnets for water "treatment", rather than heating is known in the art. There are several patents which disclose various apparatus that utilize permanent magnets in generating an eddy current for heating a liquid, most of which are cost-prohibitive complex structures, and some of which are unsafe for use.

Hagerty, U.S. Pat. No. 4,217,475 discloses a device for transferring heat to liquids which utilizes a first set of permanent magnets arranged in a circle inside a housing, a second set of magnets mounted on a rotating shaft spaced from the first set, with two concentric conductive sleeves located in the magnetic field between the two sets of magnets. The magnetic field causes the sleeves to be heated by induction. The shaft is rotated by a motor. Fluid is passed through the space between the two sleeves and is heated by heat transferred by the sleeves.

de Bennetot, U.S. Pat. No. 4,486,638 discloses a device for converting rotational energy to heat by generating eddy currents which utilizes permanent magnets attached to a rotatable shaft inside of a fixed cylindrical casing of low electrical resistivity (e.g. copper). Fluid flows through a helical conduit between the magnets and the casing and becomes heated.

Gerard, U.S. Pat. No. 4,511,777 discloses a permanent magnet thermal energy system which utilizes permanent magnets attached to a rotatable shaft inside of a duct. The magnets are attached to a disk rotated by a motor which is positioned adjacent a heat absorber plate (copper). A conductive ferromagnetic plate is connected on the other side of the heat absorber plate and has a series of fins disposed in the path of the fluid (air, gas, or liquid) to be heated.

Fichtner et al, U.S. Pat. No. 4,600,821 discloses a device for converting rotational energy to heat by generating eddy current which utilizes a first set of permanent magnets arranged in a circle on a cylindrical driver inside a housing, a second set of magnets mounted on a rotating shaft (rotor) spaced from the first set. The rotor is driven by the driver in response to attraction by both sets of magnets. A wall made of low electrical resistance material separates the driver and rotor and fluid is passed through the housing over a surface of the separating wall and is heated.

Gerard et al, U.S. Pat. No. 4,614,853 discloses a permanent magnet steam generator which utilizes a dual system of magnets attached to rotatable disks with copper heat absorber plates and conductive ferro-magnetic plates similar to his previous U.S. Pat. No. 4,511,777 that are connected in opposed relation to a boiler through which liquid to be heated is passed.

Gerard, U.S. Pat. No. 5,012,060 discloses a permanent magnet thermal generator which utilizes a first set of permanent magnets arranged in a circle inside a housing, a second set of magnets mounted on a rotor spaced from the first set and having an impeller mounted at one end which conducts fluid to be heated between the magnets.

The present invention is distinguished over the prior art in general, and these patents in particular by a permanent magnet eddy current heat generator apparatus having a thermally insulated working fluid reservoir containing a working fluid and an enlongate stationary ferrous metal tube disposed in the reservoir with an elongate permanent magnet rotatably mounted inside the tube that, upon rotation, causes the tube to become heated due to the eddy current generated in the tube side wall and the heat from the tube side wall is transferred to the working fluid in the reservoir. An elongate working fluid heat pipe has a first end connected with a working fluid reservoir outlet and a second end connected with a reservoir inlet. The elongate permanent magnet is rotated by the shaft of a motor electrically and magnetically insulated from the working fluid and elongate permanent magnet. A pump, also driven by the motor shaft, is connected in fluid communication between the working fluid reservoir outlet and the heat pipe to conduct working fluid in a closed loop from the reservoir, through the heat pipe, back into the reservoir, and around the exterior of the ferrous metal tube. The heat pipe is placed in heat exchange relation in a second fluid (liquid, air or gas) to be heated, such as in a hot water tank, and the heat of the working fluid conducted through the heat pipe is transferred through the heat pipe side wall to heat the second fluid.

SUMMARY OF THE INVENTION

It is therefore an object of the present invention to provide a permanent magnet eddy current heat generator apparatus that utilizes heat produced by eddy current generated by a permanent magnet rotated by a small electric motor to heat a working fluid which in turn heats a second fluid (air, gas or liquid).

Another object of this invention is to provide a permanent magnet eddy current heat generator apparatus which utilizes water or other liquid, air, or gas as a working fluid to heat a second fluid.

Another object of this invention is to provide a permanent magnet eddy current heat generator apparatus wherein the working fluid pump and a permanent magnet are both driven by the same small electric motor.

Another object of this invention is to provide a permanent magnet eddy current heat generator apparatus wherein a working fluid pump has an impeller rotated by magnetic attraction to circulate working fluid through the system.

Another object of this invention is to provide a permanent magnet eddy current heat generator apparatus which is compact and easily connected to water heater tanks.

A further object of this invention is to provide a water heater having a permanent magnet eddy current heat generator apparatus which is more energy efficient than conventional gas and electric water heaters and will reduce energy consumption.

A still further object of this invention is to provide a permanent magnet eddy current heat generator apparatus which is simple in construction, reliable in operation, and economical to manufacture and service.

Other objects of the invention will become apparent from time to time throughout the specification and claims as hereinafter related.

The above noted objects and other objects of the invention are accomplished by a permanent magnet eddy current heat generator apparatus having a thermally insulated working fluid reservoir containing a working fluid and an enlongate stationary ferrous metal tube disposed in the reservoir with an elongate permanent magnet rotatably mounted inside the tube that, upon rotation, causes the tube to become heated due to the eddy current generated in the tube side wall and the heat from the tube side wall is transferred to the working fluid in the reservoir. An elongate working fluid heat pipe has a first end connected with a working fluid reservoir outlet and a second end connected with a reservoir inlet. The elongate permanent magnet is rotated by the shaft of a motor electrically and magnetically insulated from the working fluid and elongate permanent magnet. A pump, also driven by the motor shaft, is connected in fluid communication between the working fluid reservoir outlet and the heat pipe to conduct working fluid in a closed loop from the reservoir, through the heat pipe, back into the reservoir, and around the exterior of the ferrous metal tube. The heat pipe is placed in heat exchange relation in a second fluid (liquid, air or gas) to be heated, such as in a hot water tank, and the heat of the working fluid conducted through the heat pipe is transferred through the heat pipe side wall to heat the second fluid.

DESCRIPTION OF THE PREFERRED EMBODIMENT

Figure 1:
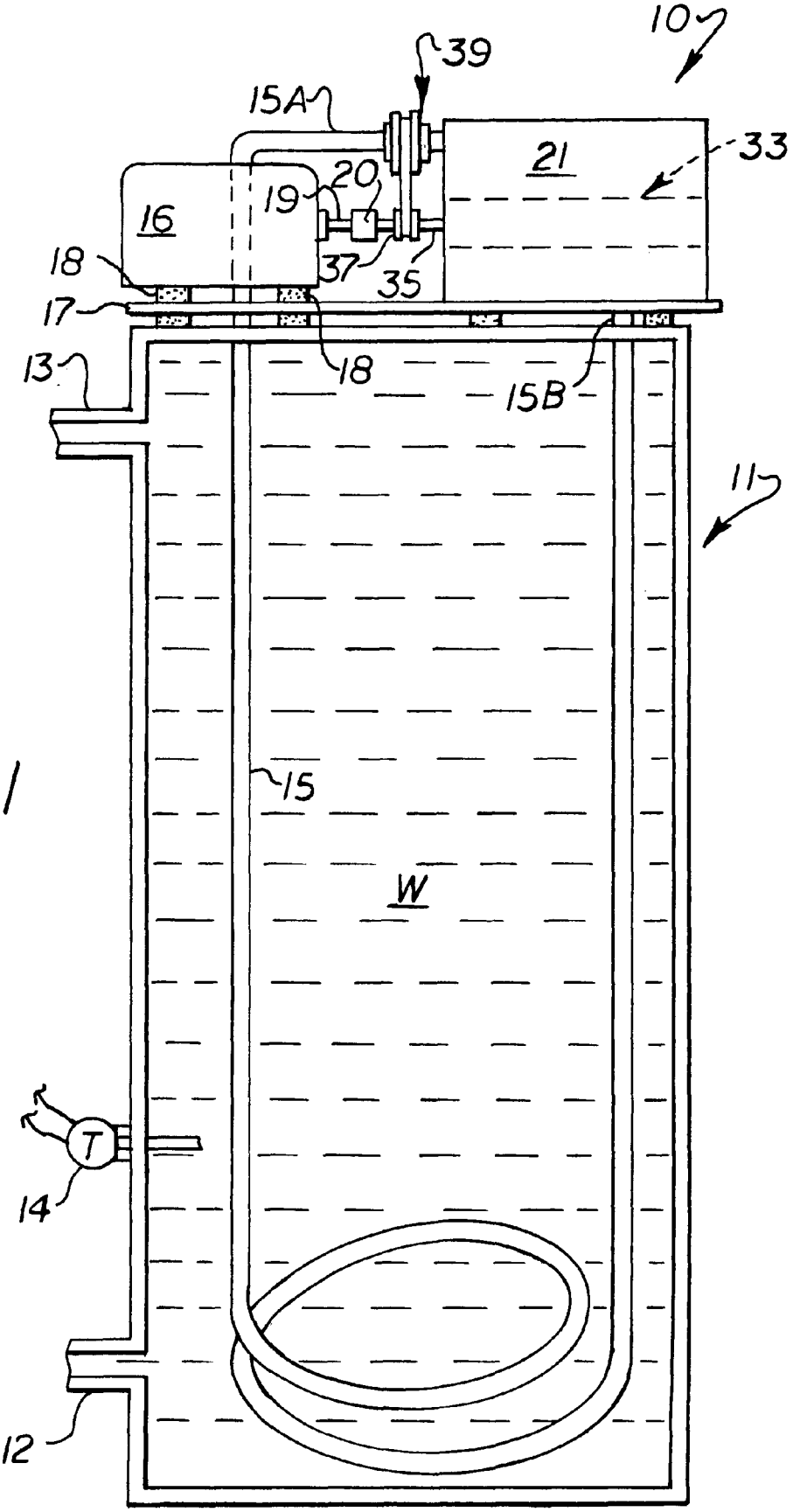
FIG. 1 is a side elevation of a permanent magnet eddy current heat generator in accordance with the present invention, shown installed on a water heater tank.

Referring to the drawings by numerals of reference, there is shown in FIG. 1, a permanent magnet eddy current heat generator 10 in accordance with the present invention mounted at the top end of a thermally insulated tank 11.

In the following description, for purposes of an example, the generator 10 is described as heating water, such as when used to generate heat for a hot water heater, and utilizing water as a working fluid for the generator, however, it should be understood that the "fluid to be heated" and the "working fluid" may be a liquid, air or gas.

As described in detail hereinafter, the apparatus 10 includes a motor 16 operatively connected with a working fluid container 21. A permanent magnet assembly 33 is rotatably mounted in the working fluid container 21 and has a shaft 35 extending outwardly from one end of the working fluid container with a drive pulley 37 mounted on the shaft. A belt-driven pump 39 in fluid communication with the interior of the working fluid container 21 is driven by the drive pulley 37.

The tank 11 containing the fluid to be heated (hot water tank in this example) has a fluid (water) supply inlet 12 near its lower end connected with a source of fluid (water) water to be heated and a hot fluid (water) outlet 13 near its upper end connected with a hot fluid (water) supply line for supplying hot fluid (water) where needed. The tank 11 is insulated, such as a conventional hot water tank of construction well know in the art, and therefore is not shown in detail. A thermostat 14 is mounted on the tank 11 in fluid communication with the fluid (water) contained in the tank and is connected to the motor 21 to control its operation in the manner of a conventional, commercialy available thermostat control.

An elongate heat pipe 15 disposed in the interior of the hot fluid (water) tank 11 has one end 15A connected to the outlet end of the pump 39 and its other end 15B connected in fluid communication with the interior of the working fluid container 21. In a preferred embodiment, the heat pipe 15 is formed of copper tubing. The heat pipe 15 may be coiled inside the hot water tank 11. It should be understood that more than one heat pipe may be disposed inside the tank 11 with their ends joined by a header pipe or manifold to the pump 39 and the working fluid container 21.

The motor 16 and the working fluid container 21 are mounted on a support base 17. The motor 20 is mounted on the base 21 by rubber mounts 18 and the base may be provided with rubber support legs. The shaft 23 of the motor 20 is connected to the outwardly extended end of the shaft of the permanent magnet assembly in the working fluid container 30 by a rubber coupling 20. The rubber mounts 18 and rubber coupling 20 isolate the motor 16 and substantially eliminate the possibility of water or pipe electrical shocking caused by electricity being conducted from the motor to the water or water conducting pipes.

Figure 2:
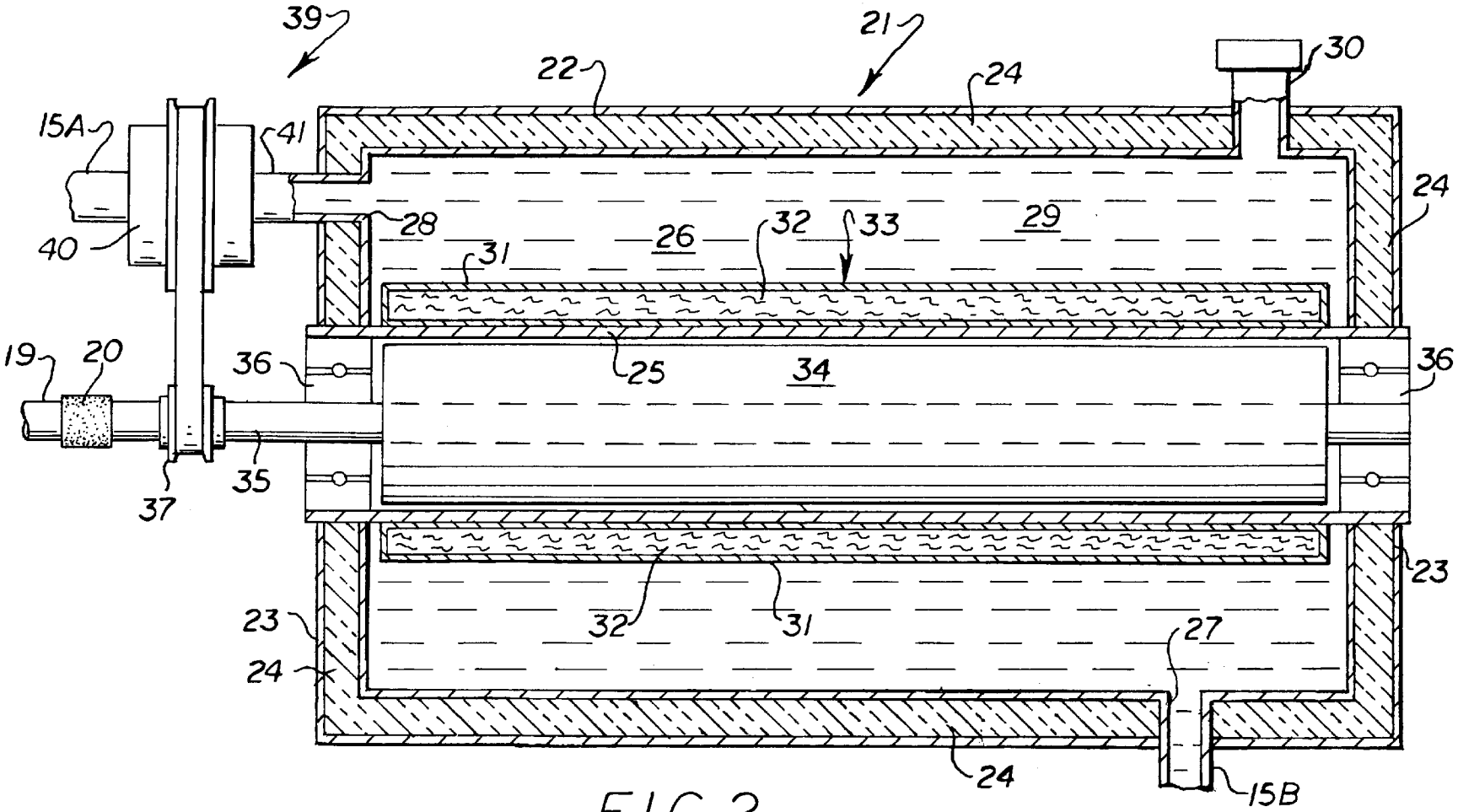
FIG. 2 is a longitudinal cross section through the transfer fluid container and magnet assembly of the permanent magnet eddy current heat generator apparatus.
Figure 3:
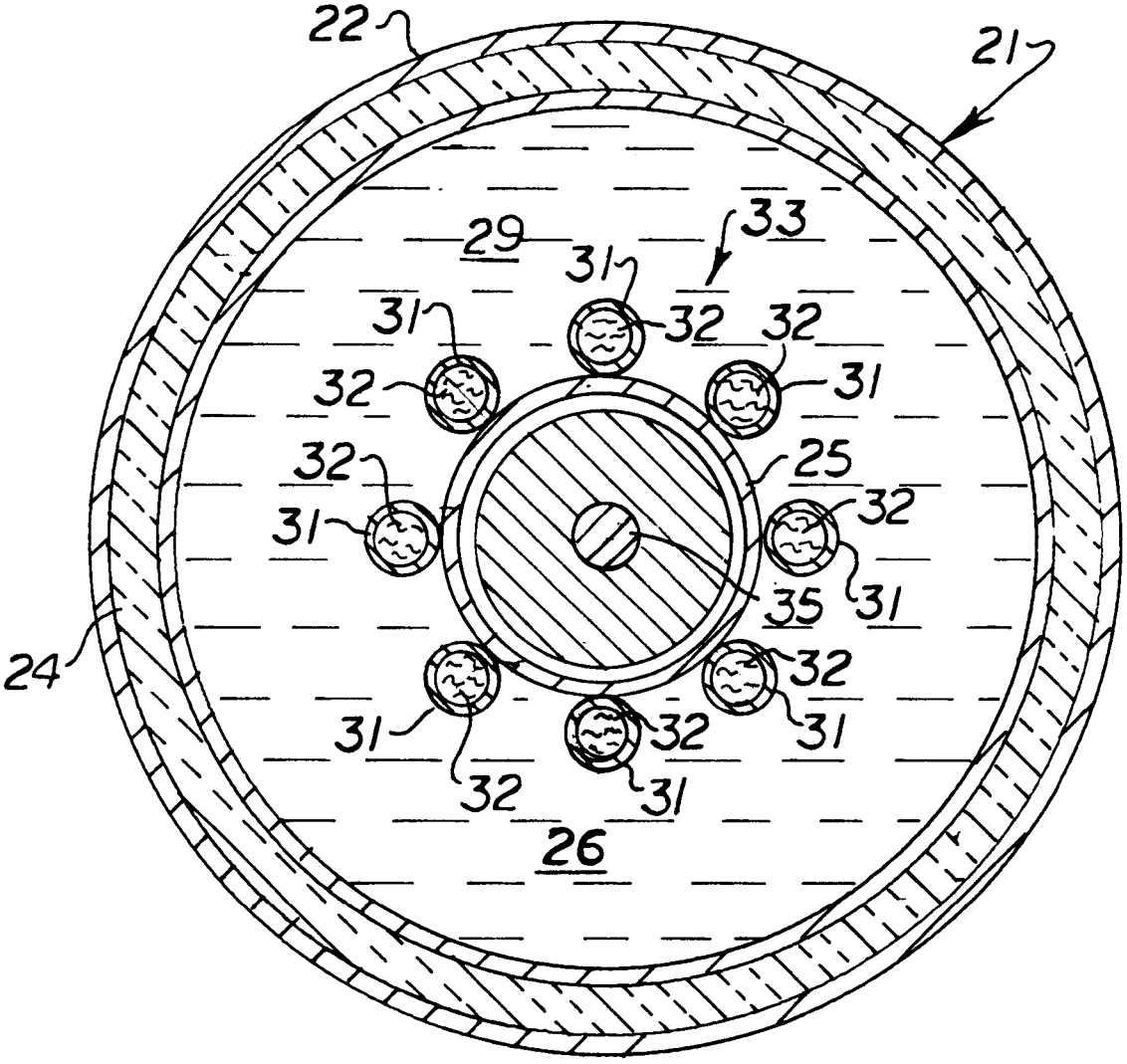
FIG. 3 is a transverse cross section through the transfer fluid container and magnet assembly of the permanent magnet eddy current heat generator apparatus.

As best seen in FIGS. 2 and 3, the working fluid container 21 is a cylindrical enclosure having a side wall 22, and opposed end walls 23 of double-wall construction with thermally insulating material 24 disposed between the double walls. It should be understood that the container 21 may also be a box-like enclosure, or may be a closed-loop coil of tubing coiled around the heat pipe 15. A ferrous metal tube 25 is secured through the center of the working fluid container 21 and the ends walls 23 are sealed around the opposed ends of the tube to form a water-tight chamber 26 surrounding the tube 25. The container 21 has a fluid inlet 27 in its bottom wall connected to one end 15B of the heat pipe 15 and a fluid outlet 28 near its upper end connected with the pump 39 and the other end 15A of the heat pipe. The chamber 26 of the working fluid container 21 and heat pipe 15 joined thereto are filled with a heat transfer fluid 29, such as water or other liquid, air or gas, through a capped fill inlet 30. A plurality of smaller diameter copper tubes 31 filled with liquid silicone 32 and sealed at each end are secured to the exterior of the ferrous metal tube 25 in circumferentially spaced relation along its length.

The magnet assembly 33 includes an elongate permanent magnet 34 secured to a shaft 35 passing through its center to rotate therewith. In a preferred embodiment, the magnet 34 is a ceramic magnet secured to a stainless steel shaft 35. The magnet 34 is received inside the ferrous metal tube 25 and the ends of the shaft 35 are rotatably mounted in bearings 36 installed in the outer ends of the ferrous metal tube. One end of the shaft 35 extends outwardly beyond the bearing 36 at one end of the ferrous metal tube 25. Thus, the magnet assembly 33 is isolated from the working fluid 29 in the working fluid container 21 by the ferrous metal tube 25. In a preferred embodiment the magnet 34 is approximately 2" in diameter and a small gap is provided between the inside surface of the tube 25 and outside surface of the magnet. Although the magnet 34 is illustrated as a single cylindrical magnet, it may be made up of a plurality of adjacent disk-shaped magnets.

As stated above, the outwardly extended end of the shaft 35 is connected to the shaft 19 of the motor 16 by a rubber coupling 20. A drive pulley 37 is secured to the shaft 35 to rotate therewith and connected by an endless-loop belt 38 to drive the pump assembly 39.

Figure 5:
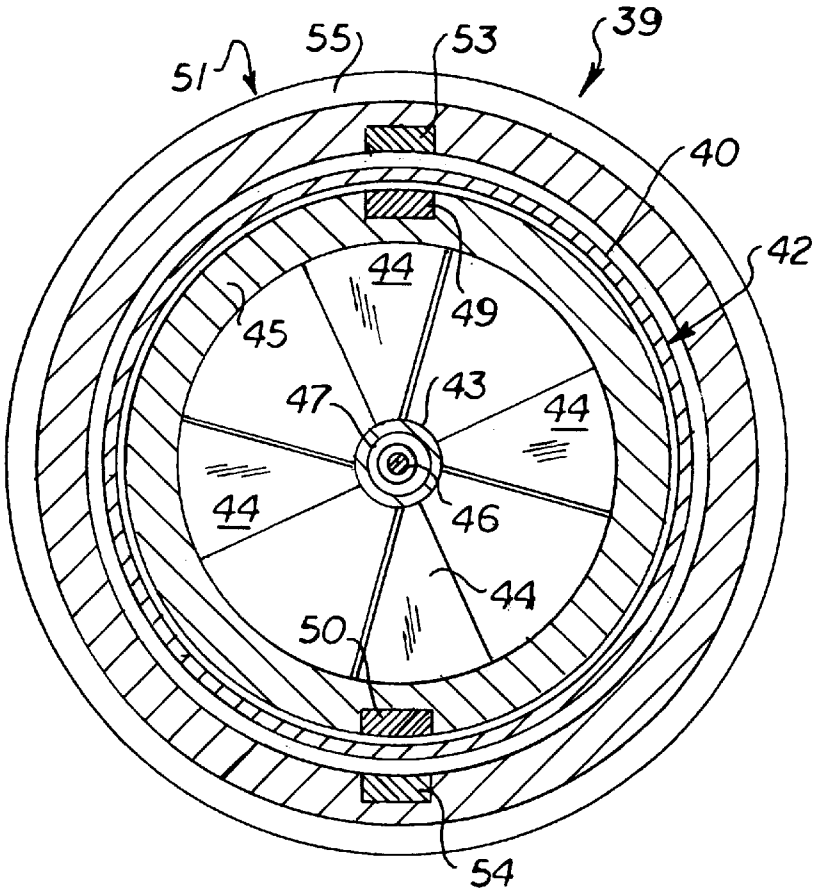
FIG. 5 is a transverse cross section through the pump assembly of the eddy current heat generator apparatus.
Figure 4:
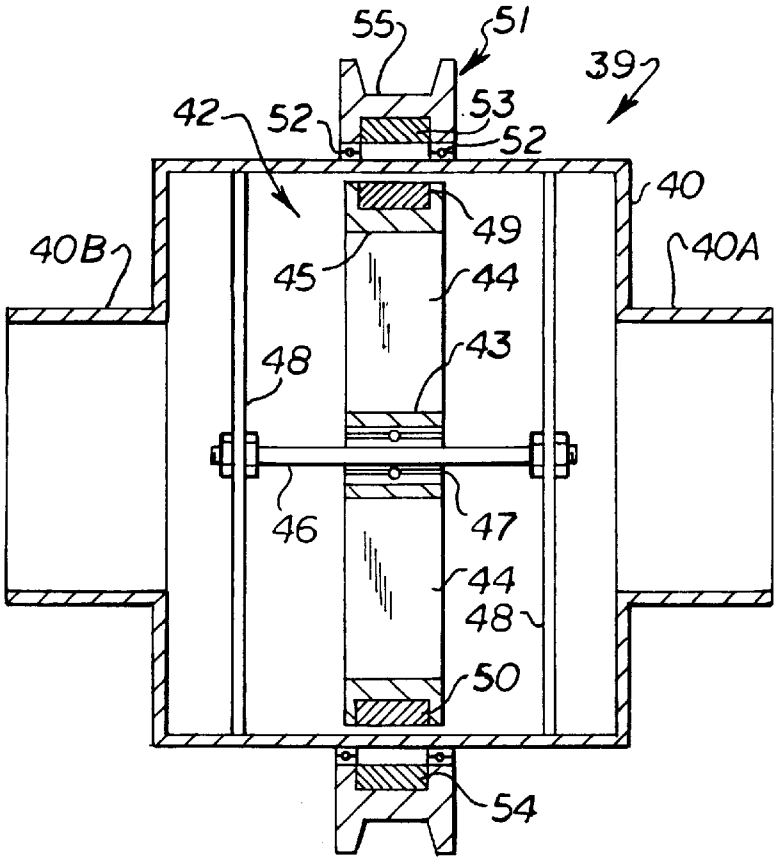
FIG. 4 is a longitudinal cross section through the pump assembly of the eddy current heat generator apparatus.

Referring now to FIGS. 4 and 5, the pump assembly 39 includes a hollow cylindrical housing 40 having an inlet end 40A connected at one end to the outlet 28 of the fluid transfer container 21 by a short length of pipe 41 and an outlet end 40B connected to the heat pipe 15 that extends into the hot fluid (water) tank 11. A rotor or impeller 42 having a central hub 43 and a series of blades 44 extending radially outward from the hub secured at their outer ends to a circular flat ring 45 is rotatably mounted in the interior of the housing 40. The surface of the blades 44 are angularly disposed relative to their radial axis. The impeller hub 43 is rotabably mounted on a stationary shaft 46 by a bearing 47. The outer ends of the shaft 46 are secured to narrow rectangular supports 48 that are secured to the interior of the housing 40. A first and second permanent magnet 49 and 50 are secured flush in the outer facing surface of the flat ring 45 in diametrically opposed relation.

A ring-like outer pulley 51 is rotatably mounted on the exterior of the cylindrical pump housing 40 by a bearing 52 to rotate relative to the housing. A first and second permanent magnet 53 and 54 are secured flush in the inner facing surface of the outer pulley 51 in diametrically opposed relation. The outer surface of the outer pulley 51 has a circumferential groove 55 to receive the drive belt 38. Thus, the drive belt 38 forms an endless loop around the drive pulley 37 driven by the motor 16 and the outer pulley 51 of the pump assembly 39.

In a preferred embodiment, the pump housing 40, impeller 42, and outer pulley 51 are formed of non-magnetic material to facilitate attraction of the magnets 49, 50, 53, and 54.

There is a small gap between the outer periphery of the flat ring 45 and the inner surface of the cylindrical pump housing 40. The magnets 49 and 50 in the flat ring 45 are spaced radially inwardly from the magnets 53 and 54 in the outer pulley 51 with the opposite poles of the magnets facing to provide magnetic attraction so that upon rotation of the outer pulley 51, the impeller 42 will be rotated due to the magnetically attracted magnets.

Operation of the motor 16 is controlled by the thermostat 14 in fluid communication with the interior of the hot fluid (water) tank 11. Optionally, a thermostat (not shown) in fluid communication with the interior of the working fluid container 21 may be provided which is connected to the motor to shut the motor off if the fluid in the container reaches an unsafe temperature.

OPERATION

Upon the thermostat 14 in fluid communication with the interior of the hot fluid (water) tank 11 sensing a predetermined low temperature of the water in the tank, power is supplied to the motor 16 to turn it on.

The rotating shaft 19 of the motor 11 rotates the drive pulley 37 which rotates the outer pulley 51 of the pump 39 via the drive belt 38, and also rotates the elongate magnet 34 housed in the ferrous metal tube 25 inside the fluid transfer container 21.

Rotation of the magnet 34 inside the ferrous metal tube 25 causes heat to build up in the tube 25 due to the eddy current generated in the tube and the heat is transferred to the fluid 29 in the working fluid container 21.

As the outer pulley 51 rotates, driven by the belt 38, the pump impeller 42 rotates due to the magnetically attracted magnets 48, 49, 53, and 54. As the pump impeller 42 rotates, water is drawn through the outlet 28 of the working fluid container 21 and the working fluid is circulated through the heat pipe 15 disposed in the interior of the hot fluid (water) tank 11 and back into the working fluid container 21. A check valve (not shown) may be provided between the inlet 27 and heat pipe 15 to prevent reverse flow of the working fluid. The heat pipe 15 becomes heated by the hot working fluid passing therethrough and the heat is transferred to the fluid (water) in the hot fluid (water) tank 11.

Upon the thermostat 14 sensing a predetermined high temperature of the fluid (water) in the hot fluid (water) tank 11, power is shut off to the motor 16 to turn it off.

The plurality of sealed copper tubes 31 containing liquid silicone 32 that are secured to the exterior of the ferrous metal tube 25 facilitate retention of the heat in the working fluid container 21 after the magnet 34 has stopped turning, and thereby increases operating efficiency.

While this invention has been described fully and completely with special emphasis upon a preferred embodiment, it should be understood that within the scope of the appended claims the invention may be practiced otherwise than as specifically described herein.

What is claimed is:

1. A permanent magnet eddy current heat generator apparatus for heating a fluid, comprising:

a thermally insulated working fluid reservoir containing a working fluid having a working fluid inlet and working fluid outlet;

an enlongate stationary ferrous metal tube in said working fluid reservoir having a side wall with an inside surface sealed from said working fluid in said reservoir and an exterior surface surrounded by said working fluid in said reservoir in heat exchange relation;

an elongate permanent magnet rotatably mounted concentrically inside said ferrous metal tube to generate an eddy current in said side wall upon rotation and thereby generate heat in said ferrous metal tube which is transferred to the surrounding working fluid in said reservoir;

an elongate working fluid heat pipe having a side wall with a first end connected in fluid communication with said working fluid outlet and a second end connected in fluid communication with said reservoir inlet whereby said working fluid is conducted in a closed loop from said reservoir, through said heat pipe, back into said reservoir, and around said exterior surface of said ferrous metal tube;

a motor having a shaft connected with said elongate permanent magnet for rotating said elongate permanent magnet, said motor and said motor shaft electrically and magnetically insulated from said working fluid and said elongate permanent magnet; and pump means driven by said motor shaft and connected in fluid communication between said working fluid reservoir outlet and said heat pipe to conduct said working fluid from said reservoir, through said heat pipe, back into said reservoir, and around the exterior surface of said ferrous metal tube; wherein said heat pipe is placed in heat exchange relation in a second fluid to be heated and the heat of said working fluid conducted through said heat pipe is transferred through said heat pipe side wall to heat said second fluid.

2. The permanent magnet eddy current heat generator according to claim 1, further comprising heat retaining means on said enlongate stationary ferrous metal tube exterior surface through which the heat generated in said ferrous metal tube side wall passes when being transferred to the surrounding working fluid in said reservoir for retaining heat in said surrounding working fluid for a period of time after said elongate permanent magnet has stopped rotating.

3. The permanent magnet eddy current heat generator according to claim 2, wherein said heat retaining means comprises at least one tubular member in contact with said exterior surface of said ferrous metal tube and said working fluid in said reservoir and containing a heat retaining substance that cools slowly to retain heat in said surrounding working fluid for a period of time after said elongate permanent magnet has stopped rotating.

4. The permanent magnet eddy current heat generator according to claim 3, wherein said at least one tubular member is formed of copper tubing filled with said heat retaining substance.

5. The permanent magnet eddy current heat generator according to claim 3, wherein said heat retaining substance is silicone.

6. The permanent magnet eddy current heat generator according to claim 1, wherein:

said pump means comprises a housing connected in fluid communication between said working fluid reservoir outlet and said heat pipe; and an impeller rotatably mounted in said housing and operatively connected with said motor shaft through drive means for imparting rotation thereto, said impeller having radially extending blades configured to conduct said working fluid from said reservoir, through said heat pipe, back into said reservoir, and around the exterior surface of said ferrous metal tube.

7. The permanent magnet eddy current heat generator according to claim 6, wherein:

said pump means housing comprises a hollow cylindrical housing formed of non-magnetic material having a circular outer pulley formed of non-magnetic material rotatably mounted on the exterior thereof to rotate relative to said housing;

said outer pulley has a circumferential groove and at least one pair of first permanent magnets secured on an inner surface thereof in diametrically opposed relation; and said impeller has a peripheral circular flat ring formed of non-magnetic material spaced radially inward from the interior surface of said housing to define a small annular gap therebetween and at least one pair of second permanent magnets secured on an outer surface thereof in diametrically opposed relation;

a drive pulley mounted on said motor shaft and having a circumferential groove;

an endless-loop drive belt received in said circumferential groove of said drive pulley and said outer pulley to cause rotary motion of said drive pulley and said outer pulley when said motor is in operation; and said pair of second magnets of said impeller being spaced radially inwardly from said pair of first magnets in said outer pulley with opposite poles of said first and second magnets facing to provide magnetic attraction such that upon rotation of said outer pulley said impeller will be rotated due to magnetic attraction between said first and second magnets.

8. The permanent magnet eddy current heat generator according to claim 1, further comprising:

a thermally insulated tank containing said fluid to be heated and having a fluid supply inlet connected with a source of fluid to be heated and a hot fluid outlet connected with a hot fluid supply line for supplying hot fluid.

9. The permanent magnet eddy current heat generator according to claim 1, wherein said working fluid comprises water.

10. A permanent magnet eddy current water heater apparatus for heating water, comprising:

a thermally insulated water tank containing water and having a water supply inlet connected with a source of water to be heated and a hot water outlet connected with a hot water supply line for supplying hot water;

a thermally insulated working fluid reservoir containing a working fluid having a working fluid inlet and working fluid outlet;

an enlongate stationary ferrous metal tube in said working fluid reservoir having a side wall with an inside surface sealed from said working fluid in said reservoir and an exterior surface surrounded by said working fluid in said reservoir in heat exchange relation;

an elongate permanent magnet rotatably mounted concentrically inside said ferrous metal tube to generate an eddy current in said side wall upon rotation and thereby generate heat in said ferrous metal tube which is transferred to the surrounding working fluid in said reservoir;

an elongate working fluid heat pipe having a side wall substantially submerged in said water in said water tank with a first end connected in fluid communication with said working fluid outlet and a second end connected in fluid communication with said reservoir inlet whereby said working fluid is conducted in a closed loop from said reservoir, through said heat pipe, back into said reservoir, and around said exterior surface of said ferrous metal tube;

a motor having a shaft connected with said elongate permanent magnet for rotating said elongate permanent magnet, said motor and said motor shaft electrically and magnetically insulated from said working fluid and said elongate permanent magnet; and pump means driven by said motor shaft and connected in fluid communication between said working fluid reservoir outlet and said heat pipe to conduct said working fluid from said reservoir, through said heat pipe, back into said reservoir, and around the exterior surface of said ferrous metal tube; wherein said heat pipe is disposed in heat exchange relation in said water in said water tank and the heat of said working fluid conducted through said heat pipe is transferred through said heat pipe side wall to heat said water in said water tank.

11. The permanent magnet eddy current water heater according to claim 10, further comprising heat retaining means on said enlongate stationary ferrous metal tube exterior surface through which the heat generated in said ferrous metal tube side wall passes when being transferred to the surrounding working fluid in said reservoir for retaining heat in said surrounding working fluid for a period of time after said elongate permanent magnet has stopped rotating.

12. The permanent magnet eddy current water heater according to claim 11, wherein said heat retaining means comprises at least one tubular member in contact with said exterior surface of said ferrous metal tube and said working fluid in said reservoir and containing a heat retaining substance that cools slowly to retain heat in said surrounding working fluid for a period of time after said elongate permanent magnet has stopped rotating.

13. The permanent magnet eddy current water heater according to claim 12, wherein said at least one tubular member is formed of copper tubing filled with said heat retaining substance.

14. The permanent magnet eddy current water heater according to claim 12, wherein said heat retaining substance is silicone.

15. The permanent magnet eddy current water heater according to claim 10, wherein:

said pump means comprises a housing connected in fluid communication between said working fluid reservoir outlet and said heat pipe; and an impeller rotatably mounted in said housing and operatively connected with said motor shaft through drive means for imparting rotation thereto, said impeller having radially extending blades configured to conduct said working fluid from said reservoir, through said heat pipe, back into said reservoir, and around the exterior surface of said ferrous metal tube.

16. The permanent magnet eddy current water heater according to claim 15, wherein:

said pump means housing comprises a hollow cylindrical housing formed of non-magnetic material having a circular outer pulley formed of non-magnetic material rotatably mounted on the exterior thereof to rotate relative to said housing;

said outer pulley has a circumferential groove and at least one pair of first permanent magnets secured on an inner surface thereof in diametrically opposed relation; and said impeller has a peripheral circular flat ring formed of non-magnetic material spaced radially inward from the interior surface of said housing to define a small annular gap therebetween and at least one pair of second permanent magnets secured on an outer surface thereof in diametrically opposed relation;

a drive pulley mounted on said motor shaft and having a circumferential groove;

an endless-loop drive belt received in said circumferential groove of said drive pulley and said outer pulley to cause rotary motion of said drive pulley and said outer pulley when said motor is in operation; and said pair of second magnets of said impeller being spaced radially inwardly from said pair of first magnets in said outer pulley with opposite poles of said first and second magnets facing to provide magnetic attraction such that upon rotation of said outer pulley said impeller will be rotated due to magnetic attraction between said first and second magnets.

17. The permanent magnet eddy current water heater according to claim 10, wherein said working fluid comprises water.

* * * * *